US005996504A

United States Patent [19]

Lowery

[11] Patent Number: 5,996,504

[45] Date of Patent: Dec. 7, 1999

[54] BARBED WIRE DEPLOYMENT APPARATUS

[76] Inventor: Samuel R. Lowery, 4 Clover Dr., Hollidaysburg, Pa. 16648

[21] Appl. No.: 09/132,375

[22] Filed: Aug. 11, 1998

Related U.S. Application Data

[62] Division of application No. 08/935,811, Sep. 23, 1997, abandoned.

[60] Provisional application No. 60/051,769, Jul. 7, 1997.

[51] Int. Cl.[6] ..... F42B 12/68; F42B 12/00

[52] U.S. Cl. ..... 102/504; 102/293; 102/502; 102/506; 89/1.11; 89/1.34

[58] Field of Search ..... 102/293, 371, 102/489, 502, 504, 506; 89/1.11, 1.34

[56] References Cited

U.S. PATENT DOCUMENTS

| | | | |
|---|---|---|---|
| 1,211,001 | 1/1917 | Steinmetz | 102/504 |
| 1,247,331 | 11/1917 | Robinson | 102/504 |
| 1,536,164 | 5/1925 | Tainton | 102/504 |
| 2,373,364 | 4/1945 | Wellcome | 102/504 |
| 2,668,499 | 2/1954 | Mawlagire | 102/504 |
| 3,893,642 | 7/1975 | Van Vlaendiren | 245/2 |
| 5,315,932 | 5/1994 | Bertram | 102/504 |
| 5,561,263 | 10/1996 | Baillard | 102/504 |

FOREIGN PATENT DOCUMENTS

| | | | |
|---|---|---|---|
| 76879 | 6/1919 | Germany | 102/504 |
| 59-130392 | 7/1984 | Japan . | |
| 63-264989 | 11/1988 | Japan . | |
| 3-197013 | 8/1991 | Japan . | |

*Primary Examiner*—Harold J. Tudor
*Attorney, Agent, or Firm*—John J. Elnitski, Jr

[57] ABSTRACT

The present invention provides a viable, practical and useful alternative to conventional metal barbed wire that is both portable and easily deployed and has a long storage shelf life. This alternative is a cost effective alternative to metal barbed wire that is reusable, recyclable and unaffected by climactic conditions. There present invention also provides a means for rapid deployment of a permanent or temporary barrier for situations as varied as repairing a breach in a fenced enclosure or providing a no-cross zone in event of civil disturbance. This means is a self-deploying storage canister for the plastic barbed wire which uses a explosive charge for deployment.

15 Claims, 6 Drawing Sheets

BARBED WIRE DEPLOYMENT APPARATUS

This application is a divisional application of U.S. patent application Ser. No. 08/935,811, filed Sep. 23, 1977, now abandoned, and claims the benefit of U.S. Provisional application No. 60/051,769 filed on Jul. 7, 1997.

BACKGROUND

Civil and military authorities are in constant need for temporary fencing that is quick to erect. They need such fencing to control various levels of disorder in relation to crowd control, mob control, and riot control. Local and state prisons are especially in need of new ways to quickly control crowd disorder. Temporary fencing that is quick to erect is also needed for control and retention of animals in situations that could prove to be dangerous without it.

Currently in use is metal barbed wire that is rolled up in reels. The reels must be handle by personnel in order to unroll and deploy the wire. The unrolling and deploying of the wire requires great care by the personnel due to the sharp barbs. This presents a safety issue during the requirement for rapid deployment by civil and military authorities. Another issue is the storage of the wire on the reels prior to use. Since the reels could be stored for a long time before use, the wire and reels tend to rust and corrode, thereby hindering deployment for fencing.

An object of this invention is to provide a viable, practical and useful alternative to conventional metal barbed wire that is both portable and easily deployed and has a long storage shelf life. Another object of this invention is to provide a cost effective alternative to metal barbed wire that is reusable, recyclable and unaffected by climactic conditions. Another object of this invention is to provide a means for rapid deployment of a permanent or temporary barrier for situations as varied as repairing a breach in a fenced enclosure or providing a no-cross zone in event of civil disturbance.

SUMMARY OF THE INVENTION

The present invention is a barbed wire made up of a plastic wire having plastic barbs and a self deploying storage canister for barbed wire. The self-deploying storage canister includes a male half and a female half A male sleeve attached to the male half and a female sleeve attached to said female half. There is at least one containment latch to hold the halves together. An impact detonator which includes an explosive charge fits into the male sleeve. The barbed wire has a first end attached to the male sleeve and a second end attached to the female sleeve.

Deployment of the barbed wire is accomplished using the canister by impacting the canister with a solid surface and activating the impact detonator. The detonating of the explosive charge blows the male and female halves in opposite directions while releasing the containment latch. As the male and female halves move away from each other, the barbed wire is deployed between the halves.

DETAILED DESCRIPTION

Figure 1A:
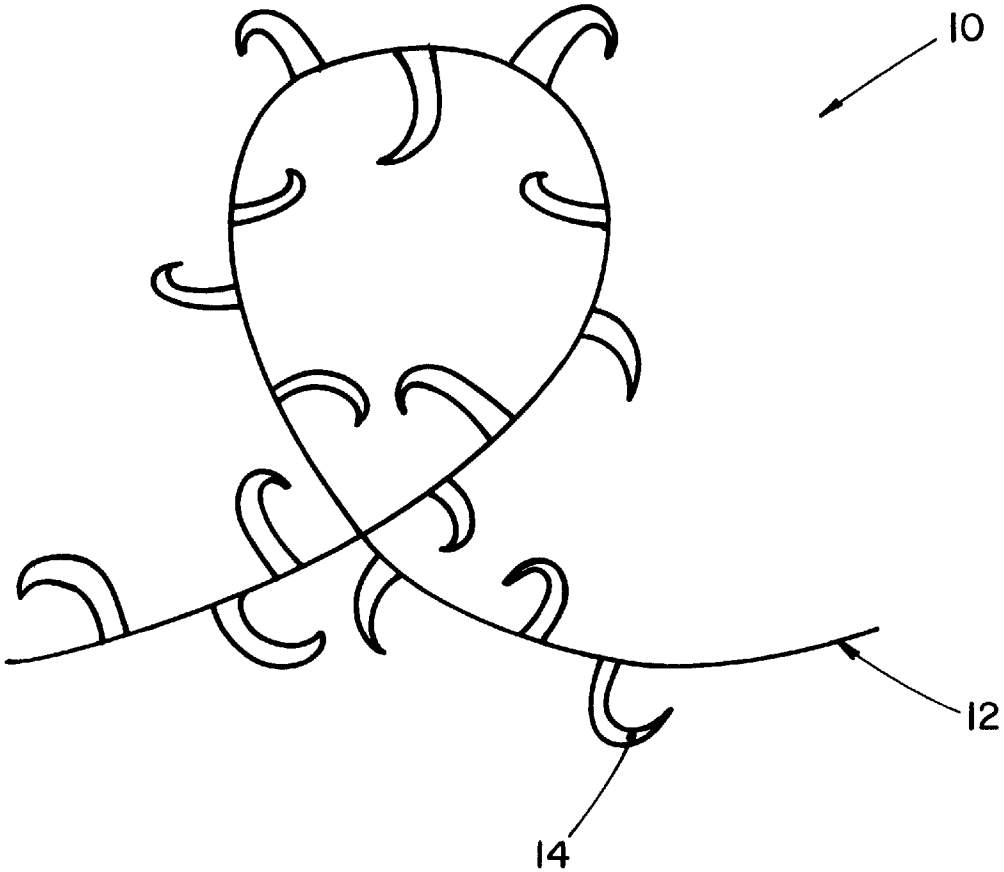
FIG. 1*a* is a perspective view of plastic barbed wire according to the present invention.
Figure 1B:
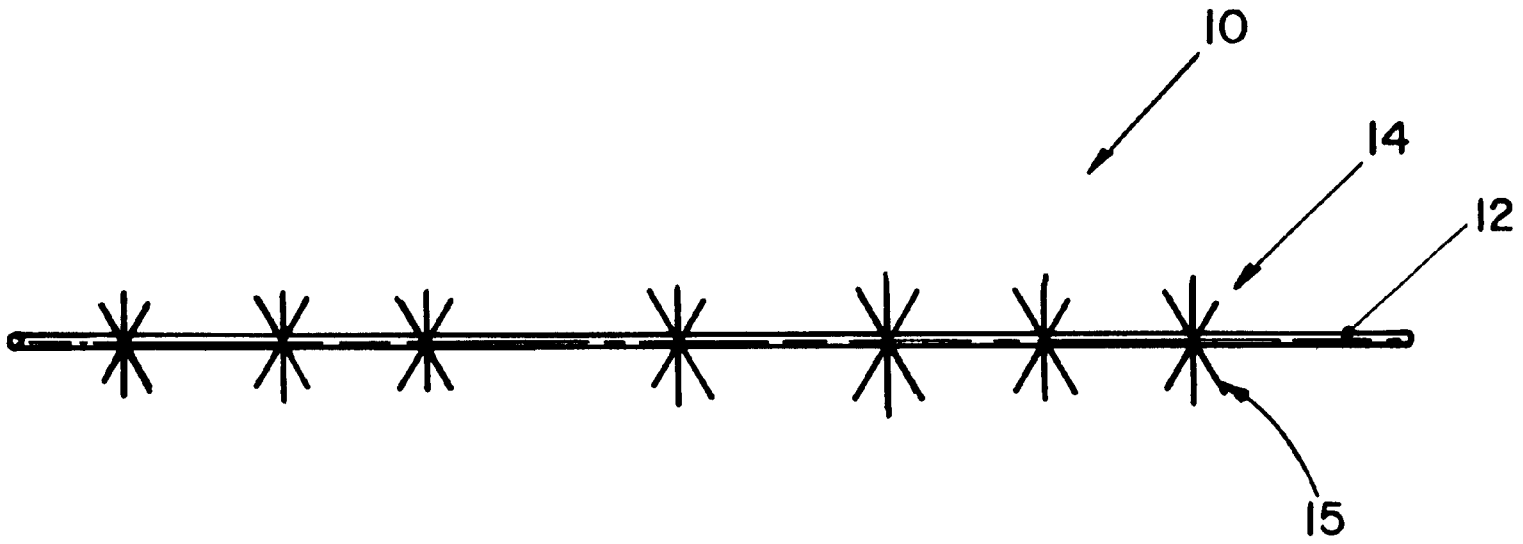
FIG. 1*b* is a perspective view of another embodiment of plastic barbed wire according to the present invention.
Figure 2:
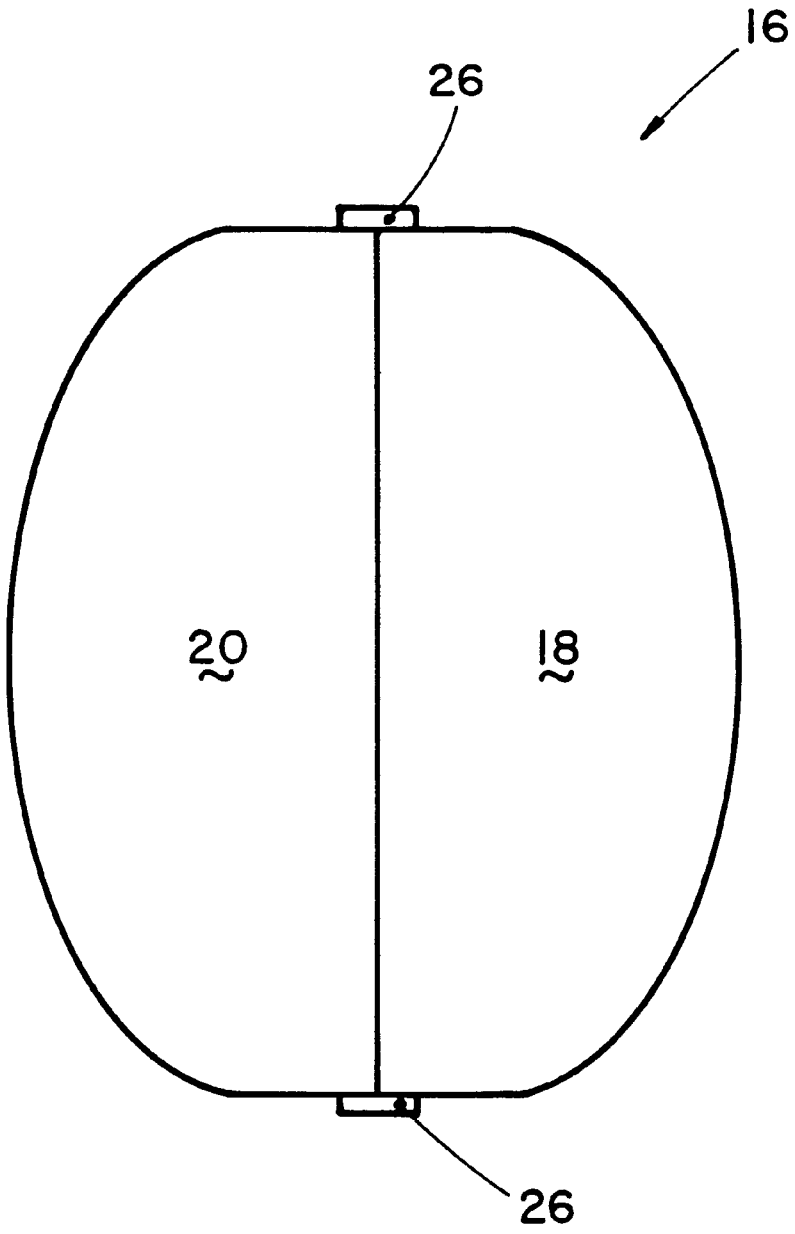
FIG. 2 is a front view of a self-deploying storage canister according to the present invention.

The present invention provides a plastic barbed wire as an alternative to metal barbed wire, and an apparatus and method of quickly deploying the plastic barbed wire. As shown in FIGS. 1*a* and 1*b,* the plastic barbed wire 10 is made of a plastic wire 12 having a series of plastic barbs 14 along the length of the plastic wire 12. FIG. 1*a* shows one embodiment of the plastic barbed wire 10 having single barbs 14 which are alternative position and direction along the wire 12. The edges of the single barbs can range from blunt to sharp, depending on intended use. The FIG. 1*b* shows a second embodiment having plastic barbs 14 with multiple tips 15. The tips 15 of the plastic barbs 14 can range from being blunt to sharp, depending on the intended use. The plastic barbed wire 10 is a viable, practical and useful alternative to conventional metal barbed wire. It can be used in conjunction with standing metal barbed wire to re-enforce, close a breach or extend a perimeter length if needed. The plastic barbed wire 10 is light weight, easily deployable and effective. In addition, plastic barbed wire 10 has an extremely long shelf life under most conditions as it is resistant to rust and decay. Its cost is inexpensive as compared with Concertina Tape and classic metal barbed wire. The plastic barbed wire 10 can be stored in any convenient and readily accessible place by civil or police authorities.

Figure 3:
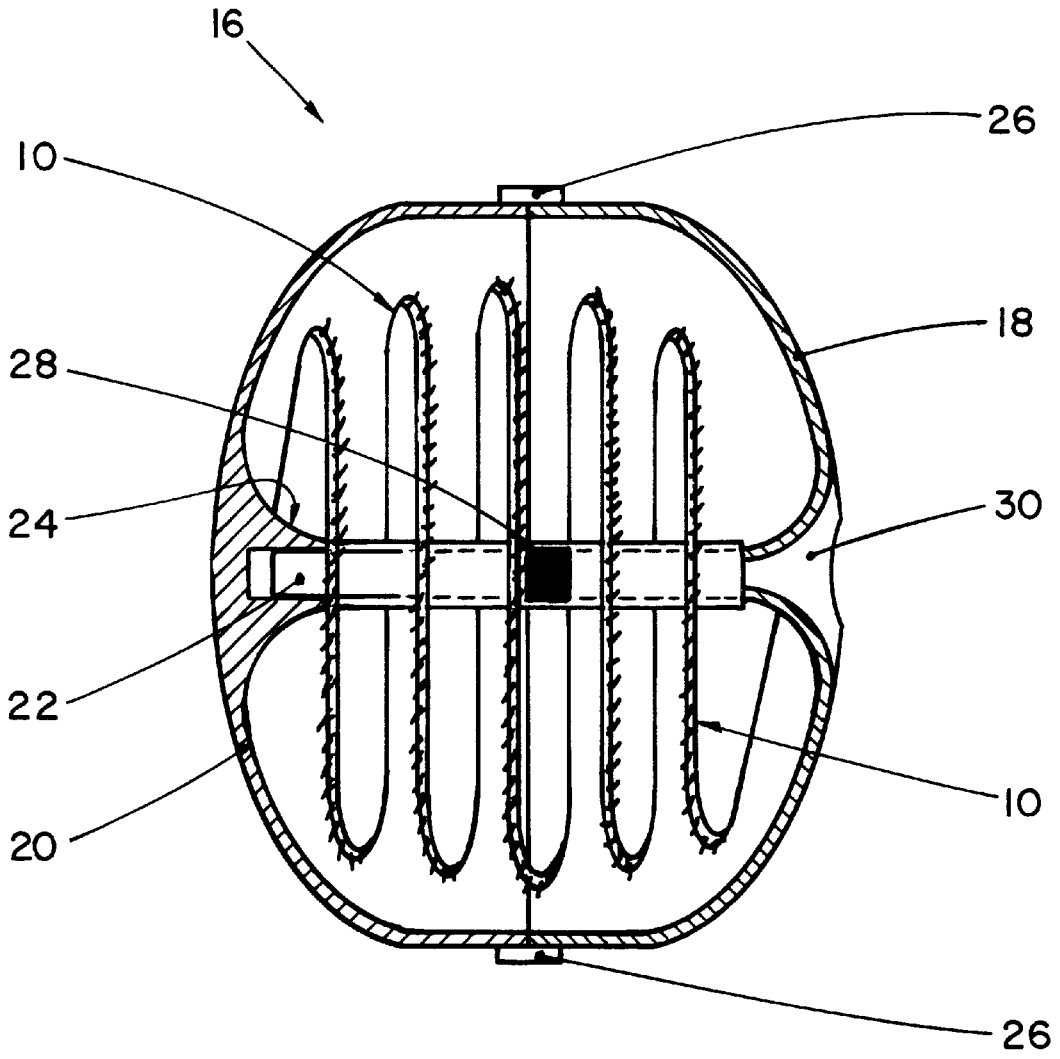
FIG. 3 is a cross-sectional view of the canister shown in FIG. 2.
Figure 4:
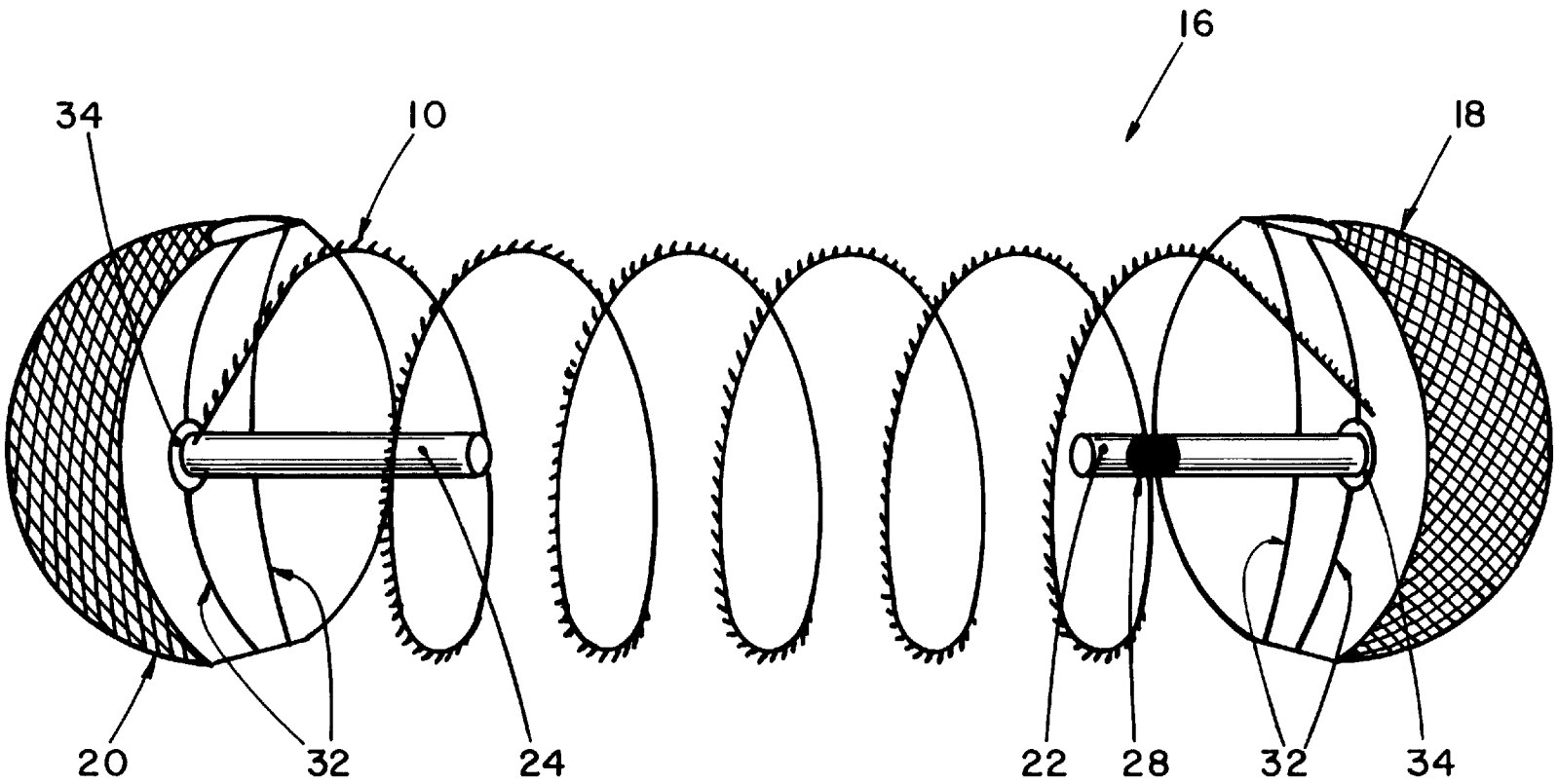
FIG. 4 is an exploded view of the canister shown in FIG. 2.

Deployment of the plastic barbed wire 10 can be from a reel as for the metal barbed wire. Another means of storage and deployment according to the present invention is a self-deploying storage canister 16 as shown in FIGS. 2–5. FIG. 4 shows an exploded view of the canister 16. The canister has a male half 18 and female half 20 which define the canister 16 as a whole. The canister halves 8,20 are molded in a semi-lunar shape with a cylindrical hollow male sleeve 22 projecting from the center of the male half 18 and a cylindrical hollow female sleeve 24 projecting from the center of the female half 20. As will be explained further in the specification, some type of securing device or method is needed to hold the male and female halves together. The male sleeve 22 slides into the female sleeve 24. thereby interconnecting when the canister halves 18,20 are assembled. As shown in FIG. 3, the plastic barbed wire 10 is coiled inside the closed canister 16. As shown in FIGS. 3 and 4, one end of the plastic barbed wire 10 is attached to the male half 18 at a point where the male sleeve 22 is molded into the male half 18. The other end of the plastic barbed wire 10 is attached to the female half 20 at a point where the female sleeve 24 is molded into the female half 20. Canister halves 18, 20 are fitted with containment latches 26 that keep halves 18, 20 together during transport.

Further shown in FIG. 3 is an impact detonator 28 with an explosive charge. The impact detonator 28 is placed in the male sleeve 22 so that when the male sleeve 22 is inserted into the female sleeve 24, the impact detonator 28 is located at the geographic center of the canister 16. When the canister 16 is deployed, impact with a solid surface actives the impact detonator 28, thereby detonating the explosive charge. The containment latches 26 are to be of a type that release or shear, thereby allowing the separation of the canister halves 18, 20 when detonation occurs. Once the impact detonator 28 is activated, the force from the detonation blows the male and female halves 18, 20 in opposite directions. As the male and female halves 18, 20 move away from each other, the plastic barbed wire 10 is deployed between the canister halves 18, 20. As shown in FIG. 3, the canister 16 could also have an insertion port 30 on the outside of the male half 18 leading to the male sleeve 22 that can be securely closed. This would allow for the impact detonator 28 to be inserted just before deployment, rather than storing the canister 16 with the impact detonator 28.

The canister halves 18, 20 are ideally made of a thin high impact plastic with reinforcement ribbing bars 32 molded on the inside of the halves 18, 20 for strength and stability. Envisioned sizes are 8"w×12"h, 8"w×18"h, 8"w×24"h, and 8"w×30"h. Delivery of the canister 16 is envisioned to be by hand launching, hand launching by an attached lanyard, rifle grenade launching, mortar launching or air drop. Therefore, the present invention provides a deployment system that is lightweight, can be hand carried, has multi-delivery methods and has a long "shelf life" under most conditions.

Figure 5:
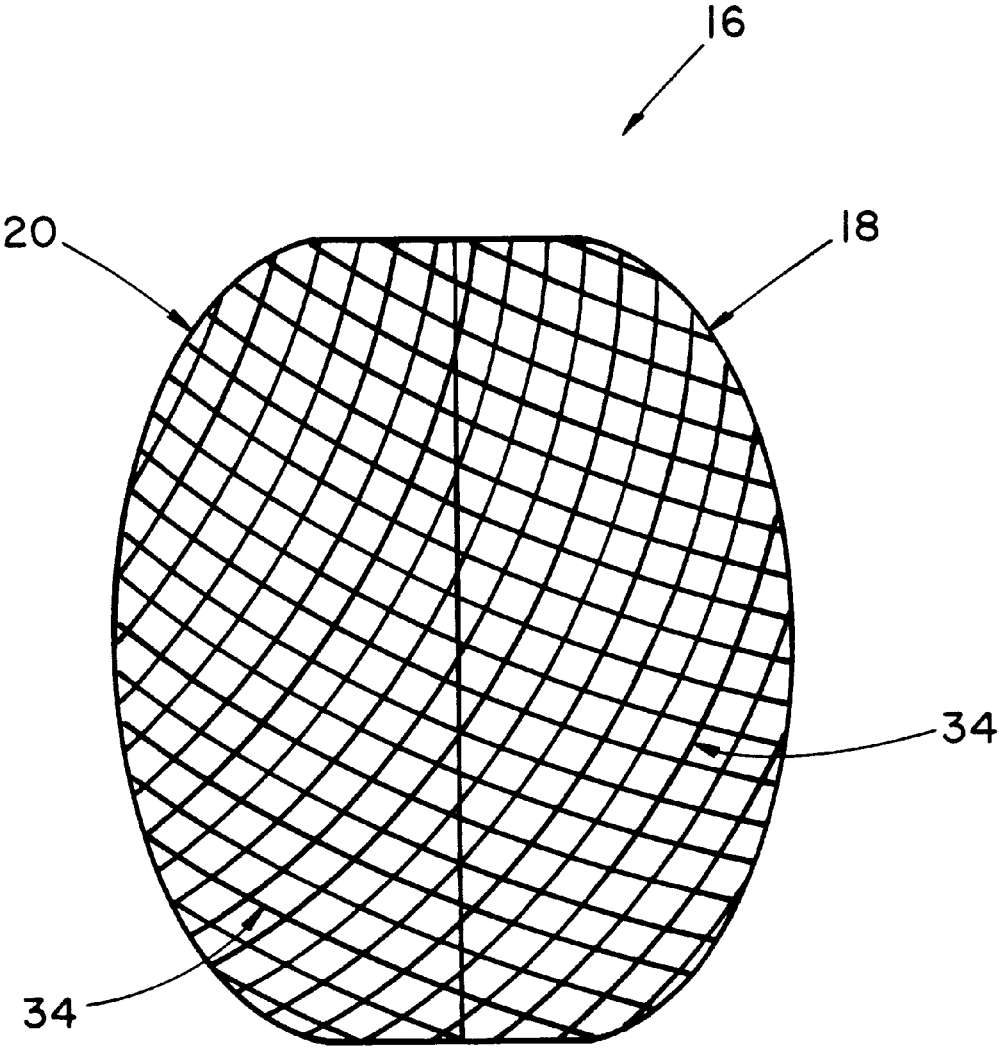
FIG. 5 is an external view of the canister with a hair net mesh according to the present invention.

Another embodiment of the self-deploying canister 16' would include a plastic or nylon "hair net" mesh about the canister 16', as shown in FIG. 5. The "hair net" mesh would be designed to shear along the connection of the male and female halves 18', 20', so it would not impede nor alter deployment of the plastic barbed wire 10. The canister halves 18', 20' would not have the reinforcement bars 32 molded on the inner surface of the halves 18', 20'. The semi-lunar halves 18', 20' would be designed for deliberate fragmentation upon activation of the impact detonator 28. On surface impact of the canister 16', the impact detonator 28 activates and exerts an explosive pressure on the center area 34 of each half 18", 20" through the attached sleeves 22, 24. Each sleeve 22, 24 acts like a piston and rod, ramming through and free of the halves 18', 20' in opposite directions, thus carrying and deploying the continuous coil of plastic barbed wire 10. In the act of deployment, the sleeves 22, 24 and the uncoiling plastic barbed wire 10 will rip and fragment the canister halves 18', 20', thereby dispersing the fragments into the "hair net" mesh 35. The "hair net" mesh provides the following added benefits of: used as a hand hold for handling the canister 16', can be use to help stabilize the canister 16' in transit and used as a lanyard for hand launching the canister 16'.

While different embodiments of the invention has been described in detail herein, it will be appreciated by those skilled in the art that various modifications and alternatives to the embodiment could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A self-deploying storage canister for barbed wire comprising:

a male half forming one half of said canister;

a female half forming another half of said canister and being in contact with said male half to form said canister;

a male sleeve attached to said male half;

a female sleeve attached to said female half;

said male sleeve being located within said female sleeve:

at least one securing device to hold said male and female halves together;

an impact detonator which includes an explosive charge mounted inside said ale sleeve; and a barbed wire having a first end attached to said male sleeve and a second end attached to said female sleeve, said barbed wire being coiled around said female sleeve and contained within said canister.

2. The canister of claim 1, wherein said at least one securing device is a containment latch which releases upon activation of said impact detonator due to separation of said male and female halves.

3. The canister of claim 1, wherein said male half includes a insertion port connected to said male sleeve for insertion of said explosive charge, said port being securely closable.

4. The canister of claim 1, wherein said at least one securing device is a hair net mesh surrounding said canister.

5. The canister of claim 1, wherein said barbed wire is plastic.

6. The canister of claim 1, wherein said male half and said female half are constructed to deliberately fragmentate due to detonation of said explosive charge.

7. The canister of claim 1, wherein said male half and said female half are of a semi-lunar shape.

8. The canister of claim 1, wherein said at least one securing device comprises a containment latch positioned at a top of said canister and a containment latch positioned at a bottom of said canister.

9. The canister of claim 4, wherein said male half and said female half are constructed to deliberately fragmentate due to detonation of said explosive charge.

10. The canister of claim 4, wherein said male half and said female half are of a semi-lunar shape.

11. A method of deploying barbed wire comprising the steps of:

a. impacting a self-deploying storage canister for barbed wire having a male half forming one half of said canister; a female half forming another half of said canister and being in contact with said male half to form said canister; a male sleeve attached to said male half; a female sleeve attached to said female half; said male sleeve being located within said-female sleeve; at least one securing device to hold said male and female halves together, an impact detonator which includes an explosive charge mounted inside said male sleeve; and a barbed wire having first end attached to said male sleeve and a second end attached to said female sleeve with a solid surface, said barbed wire being coiled around said female sleeve and contained within said canister;

b. activating the impact detonator, thereby detonating the explosive charge, where the force from the charge releases the at least one securing device holding said male and female halves together and blows the male and female halves in opposite directions from each other; and where, the barbed wire is deployed between the halves as the halves move away from each other.

12. The method of claim 11, wherein step (b) the force of the charge blows the male and female sleeves in opposite directions while fragmenting the male and female halves as the barbed wire is deployed by the movement of the male and female sleeves in opposite directions.

13. The method of claim 11, wherein said at least one securing device is a containment latch.

14. The method of claim 11, wherein said at least one securing device is a hair net mesh.

15. The method of claim 12, wherein said at least one securing device is a hair net mesh.

* * * * *